United States Patent [19]

Dresher et al.

[11] 4,223,413

[45] Sep. 23, 1980

[54] BEDSTEAD FRAME ASSEMBLY

[75] Inventors: Max S. Dresher; Glen E. Dresher, both of Glencoe; Stanley E. Bontkowski, Wood Dale, all of Ill.

[73] Assignee: Dresher Manufacturing Co., Chicago, Ill.

[21] Appl. No.: 952,553

[22] Filed: Oct. 18, 1978

[51] Int. Cl.[2] ..... E04H 17/16

[52] U.S. Cl. ..... 5/282 R; 5/285; 256/22

[58] Field of Search ..... 5/100, 279, 282 R, 282 B, 5/283, 285, 301; 16/437; 256/21, 22, 24

[56] References Cited

U.S. PATENT DOCUMENTS

| | | | |
|---|---|---|---|
| 114,439 | 5/1871 | Hollister | 5/301 |
| 608,545 | 8/1898 | Coburn | 5/301 |
| 643,589 | 2/1900 | Blaisdell | 403/252 |
| 949,108 | 2/1910 | Abel | 285/191 |
| 959,093 | 5/1910 | Wilson . | |
| 998,582 | 7/1911 | Lucas | 5/282 B |
| 1,376,626 | 5/1921 | Jones | 5/283 |
| 1,486,826 | 3/1924 | Atkinson | 5/283 |
| 1,692,080 | 11/1928 | Hass | 5/283 R |
| 3,822,053 | 7/1974 | Daily | 256/22 |
| 4,050,828 | 9/1977 | Noro | 256/22 |

*Primary Examiner*—Casmir A. Nunberg

*Attorney, Agent, or Firm*—Fitch, Even, Tabin, Flannery & Welsh

[57] ABSTRACT

A frame assembly for use in a bedstead, such as for the headboard thereof, includes a pair of lateral standards, at least one pair of tubular cross rails connected to the standards in transverse relation thereto, and one or more spindles connected to and between the cross rails transversely thereof. Each spindle has its opposite ends received within a pair of axially aligned openings formed in the cross rails and is retained in assembled relation by a pair of connector members each of which is inserted within one of the aligned openings and cooperates with the associated spindle to maintain it in relatively fixed relation to the associated cross members. The connector members are adapted for snap-fit connection with the cross rails so as to eliminate the need for tools in assembling the spindles and cross rails.

12 Claims, 5 Drawing Figures

BEDSTEAD FRAME ASSEMBLY

The present invention relates generally to frame assemblies for use in bedsteads and the like, and more particularly to a novel frame assembly and kit for making the same which finds particular application as a headboard and which includes a pair of cross rails adapted for connection to elongate standards, and at least one spindle adapted for connection to and between the cross rails through connector members having snap-fit connection to the cross rails and having cooperative association with the associated spindle in a manner to eliminate the need for tools in final assembly of the spindles and cross rails.

Recent revived interest in metallic tubular headboards for bedsteads, particularly in what are commonly termed brass bedsteads, has created a need for a simple yet highly efficient and reliable headboard frame which can be assembled for the most part without tools. In this manner, the headboard frames can be packaged in a disassembled condition and easily assembled in one's home without the need for special tools or fixtures as have heretofore been required to insure proper and reliable assembly.

One of the primary objects of the present invention is to provide a bedstead frame and kit for making the same which employs tubular spindles adapted for connection to and between tubular cross rails through connector members which eliminate the need for tools in final assembly of the spindles to the cross rails, thereby facilitating assembly in a relatively quick and simple manner.

A more particular object of the present invention is to provide a frame assembly and kit for making the same which is particularly adapted for use as a bedstead headboard and which employs elongate standards to which a pair of tubular cross rails are connected, the cross rails having axially aligned pairs of openings therethrough, and including one or more spindles disposed between the cross rails in axial alignment with pairs of openings therein, and connector members cooperable with the openings in the cross rails and the corresponding proximate ends of the spindles so as to maintain the spindles in assembled relation to the cross rails, the connector members being adapted for snap-fit connection with the respective cross rails internally of the openings therein so as to prevent release of the connector members while facilitating final assembly of the spindles and cross rails without need for tools.

A feature of the bedstead frame assembly in accordance with the present invention lies in the provision of an annular retaining ridge formed on each connector member which facilitates snap-fit insertion into an opening in a cross rail but which is of sufficient size to prevent withdrawal through the opening after assembly therethrough into cooperating relation with a corresponding proximate end of a spindle previously inserted into the opening from the opposite end thereof.

The various objects and advantages of the present invention, together with the organization and manner of operation thereof, will become apparent from the foregoing detailed description of the invention when taken in conjunction with the accompanying drawing wherein like reference numerals designate like elements throughout the several views, and wherein.

Figure 2:
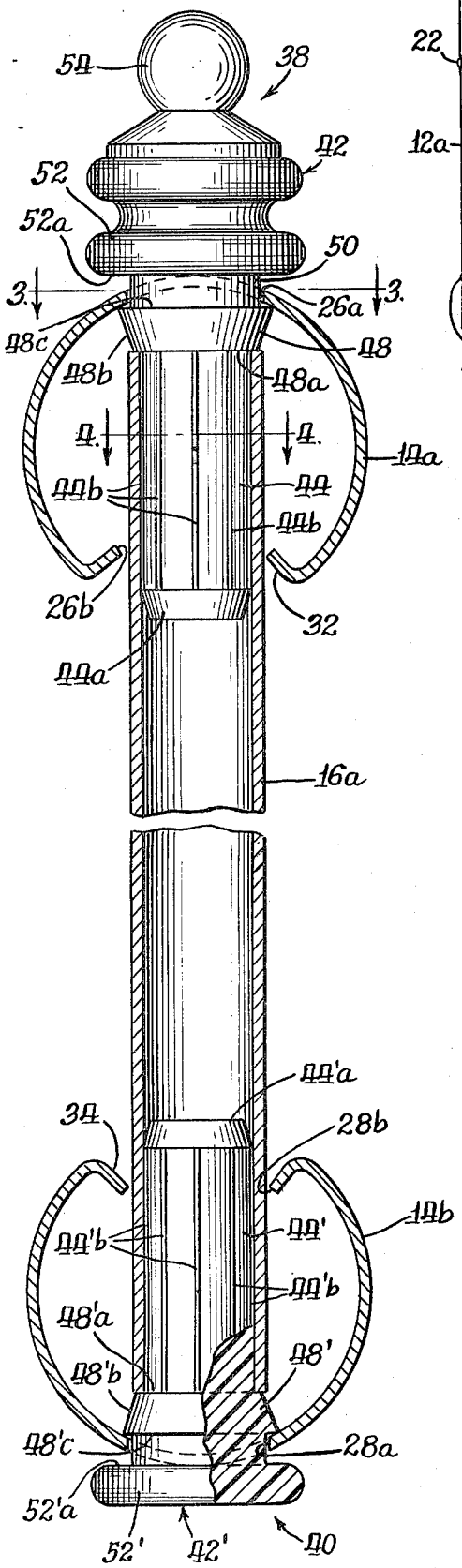
FIG. 2 is a foreshortened longitudinal sectional view, on an enlarged scale, taken substantially along line 2—2 of FIG. 1 and looking in the direction of the arrows.

Referring now to the drawing, and in particular to FIGS. 1–4, the present invention is illustrated, by way of example, as being embodied in a frame assembly in the form of a bedstead headboard indicated generally at 10. While the frame assembly 10 is described as being in the form of a headboard for a bedstead, the structural features of the frame assembly may also be applied to other frame designs of either headboard or footboard portions of a bedstead, as will become more apparent hereinbelow.

Very generally, the frame assembly or headboard 10 is made from a plurality of preferably metallic tubular members, such as brass or brass coated tubing, which include a pair of lateral elongate standards **12*a* and 12*b* which comprise the corner posts of the headboard, at least one pair of substantially parallel tubular cross rails 14*a* and 14*b* which may be termed the upper and lower cross rails, respectively, and a plurality of identical tubular spindles 16*a*–16*d* disposed between and connected to said cross members 14*a*, *b*** in transverse relation thereto.

The tubular cross rails **14*a* and 14*b* are preferably of equal cross-sectional configuration and length and are adapted to have their opposite ends connected to the standards 12*a*, *b* in transverse relation thereto through conventional means such as screws 22 each of which is received through suitable openings in its associated standard and has threaded connection with a suitable plug or nut or the like (not shown) retained within the end of the corresponding cross rail in a known manner. The elongate standards 12*a*, *b* preferably have ornamental knobs 24*a*, *b*, respectively, suitably mounted on their upper ends. The lower ends (not shown) of the elongate standards may be adapted for connection to the lateral side rails of a spring and mattress support frame so that the headboard is disposed in upstanding relation when affixed to the support frame. If desired, the lower ends of the standards 12*a*, *b*** may have rollers mounted thereon as is known.

Figure 1:
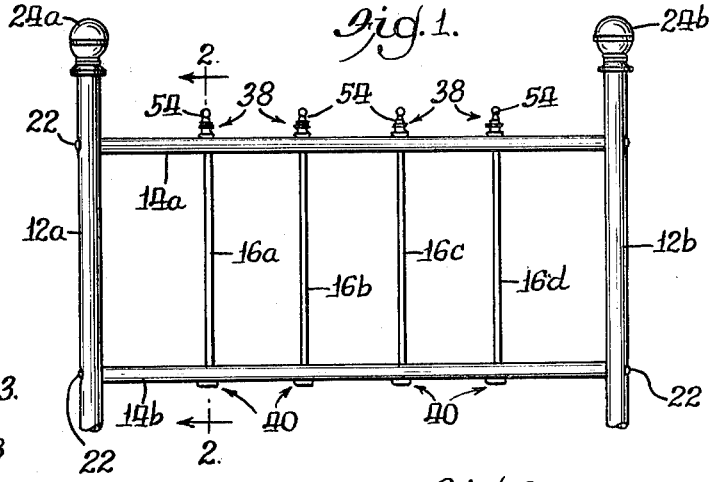
FIG. 1 is a partial front elevational view of a frame assembly in the form of a bedstead headboard constructed in accordance with the present invention.

In the embodiment illustrated in FIG. 1, the elongate standards **12*a*, *b* and transverse cross rails 14*a*, *b* are connected in a generally parallelogram arrangement with the opposite ends of the cross rails being connected to the standards intermediate the lengths thereof. The spindles 16, of which there are four illustrated in the embodiment of FIG. 1 identified as spindles 16*a–d*, are supported by and between the cross rails 14*a*, *b*** so as to be disposed in parallel relation spaced substantially equidistantly along the cross rails in coplanar relation with the cross rails and elongate standards.

Figure 3:
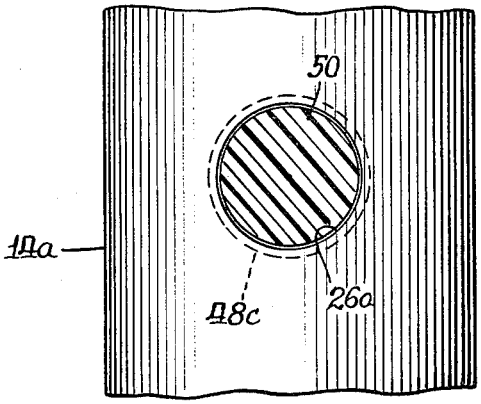
FIG. 3 is a transverse sectional view taken substantially along line 3—3 of FIG. 2, looking in the direction of the arrows.
Figure 4:
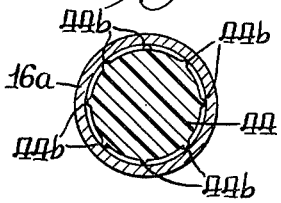
FIG. 4 is a transverse sectional view taken substantially along line 4—4 of FIG. 2, looking in the direction of the arrows.

In accordance with an important feature of the present invention, and with particular reference to FIGS. 2, 3 and 4, the spindles **16*a–d* have their opposite ends connected to the cross rails 14*a*, *b* by means which eliminate the need for tools in final assembly of the spindles to and between the cross rails. To this end, the upper and lower cross rails 14***a, b* have equal size circular transverse openings therethrough, such as indicated at 26*a, b* and 28*a, b* in the upper and lower cross rails shown in FIG. 2, so that the cross rails define axially aligned pairs of openings. Each axially aligned pair of openings, such as 26*b* and 28*b*, formed in the mutually facing surfaces of the parallel cross rails is adapted to receive the opposite ends of a tubular spindle, such as 16*a*, so that one end of the spindle is received upwardly within the opening 26*b* and the opposite end is received downwardly within the opening 28*b*. The upper and lower tubular cross rails 14*a* and 14*b* are preferably formed with annular inwardly inclined or generally frustoconical wall areas 32 and 34, respectively, circumferentially of the openings 26*b* and 28*b* to facilitate assembly of the upper and lower rails over the opposite ends of the spindles to be connected therebetween.

Connector means, indicated generally at 38 and 40, are adapted for operative connection with the upper and lower cross rails and the opposite upper and lower ends, respectively, of each spindle 16*a–d* so as to maintain the spindles in relatively fixed assembled relation to the cross rails. The upper and lower connecting means 38 and 40 are substantially similar so that only the upper connecting means 38 will be described in detail herein. The connecting means 38 includes a connector body 42 having a first cylindrical connector portion 44 adapted to be inserted through the opening 26*a* and downwardly into the upper end of the spindle 16*a* in sliding relation therein. Preferably, the lower end of the cylindrical connector portion 44 is beveled or chamfered at 44*a* to facilitate entry into the upper end of the spindle. A plurality of longitudinally extending circumferentially spaced radial ribs 44*b* are formed on the peripheral surface of the cylindrical connector portion 44 for sliding engagement with the inner surface of the tubular spindle to facilitate release of air during insertion of the connector body 42 into the upper end of the associated spindle. Alternatively the diameter of the connector portion 44 may be increased to a diameter sufficient to enter the associated spindle in sliding relation therein, and a plurality of longitudinally extending grooves may be formed in the cylindrical surface to facilitate air release as the connector portion 44 is inserted into the associated spindle.

The connector body 42 has an annular retainer boss or rim 48 formed thereon which defines an annular stop surface 48*a* at the upper end of the connector portion 44 for abutment with the upper edge of the spindle 16*a*. The retainer boss 48 has an outer frustoconical surface 48*b* the smaller diameter end of which has a diameter less than the diameter of the circular opening 26*a* and the larger diameter end of which has a diameter slightly greater than the diameter of the opening 26*a* but capable of being manually forced axially through opening 26*a*. An annular shoulder surface 48*c* is formed on the retainer boss 48 to lie in a plane normal to the longitudinal axis of the connector body contiguous to a cylindrical surface 50 having a diameter slightly less than the diameter of opening 26*a*. An annular boss or hub 52 is formed on the connector body 42 and defines an annular stop surface 52*a* mutually opposed to and parallel with the shoulder surface 48*c*. The stop surface 52*a* is spaced from the shoulder surface 48*c* so that as the connector body 42 is inserted through the opening 26*a* with the end portion 44 received within the underlying spindle 16*a*, the stop surface 52*a* will engage the outer surface of the cross rail 14*a* as the larger diameter end of the retainer boss passes or "snaps" through opening 26*a* with the shoulder surface 48*c* thereafter engaging the inner surface of the cross rail. In this manner, the connector body 42 is retained internally of the upper cross rail through a snap-fit connection therewith, the upper cross rail circumferentially of the opening 26*a* being captured between the shoulder surface 48*c* and the annular stop surface 52*a*. It will be appreciated that due to the curvature of the tubular cross rail, the points of contact of the shoulder surface 48*c* against the inner surface of the cross rail will lie in a vertical plane rotated approximately 90° from a vertical plane containing the points or lines of contact of the stop surface 52*a* against the outer surface of the cross rail. The connector body 42 may have a decorative upper end 54 formed thereon axially adjacent the boss 52 for decorative purposes.

As aforementioned, the lower connecting means 40 is substantially similar to the upper connecting means 38. To this end, the lower connecting means 40 includes a connector body 42' having a connector end portion 44' which terminates at its free end in a chamfered lead surface 44'*a* and has a plurality of circumferentially spaced longitudinally extending radial ribs 44'*b* formed on its peripheral surface to facilitate escape of air during insertion of the connector portion into the lower end of an associated spindle. The connector body 42' has a retainer boss or rim 48' formed thereon having a configuration identical to the aforenoted rim 48 on the upper connecting means 38 so as to define an annular shoulder surface 48'*c* cooperative with an opposed annular stop surface 52'*a* formed on an annular boss or hub 52' to facilitate a snap-fit connection with the lower cross rail 14*b* when the connector means 40 is inserted through the opening 28*a* in the lower cross rail. In the illustrated embodiment the lower connecting means 40 does not have a decorative knob formed thereon, such as shown at 54 on the upper connecting means 38.

The connector bodies 42 and 42' of the upper and lower connector means 38 and 40 are preferably made of a suitable plastic material which adapts itself for inexpensive mold forming manufacturing techniques. The formed plastic connector bodies may be suitably coated with a brass coating or other coating as desired to provide the desired visual effect.

Thus, in accordance with the embodiment illustrated in FIGS. 1–4, the connector means 38 and 40 are adapted for operative association with the cross rails 14*a, b* and the opposite ends of each of the spindles 16*a–d* to connect the spindles to the upper and lower cross rails, the connector means each including a connector member body 42, 42' adapted to be inserted within a corresponding one of the axially aligned openings 26*a*, 28*a* in the cross rails so as to maintain the associated spindles in relatively fixed relation to the cross rails, the connector means further being adapted for snap-fit connection with the cross rails internally thereof so as to substantially prevent withdrawal of the connector member bodies from the associated openings in the cross rails.

Figure 5:
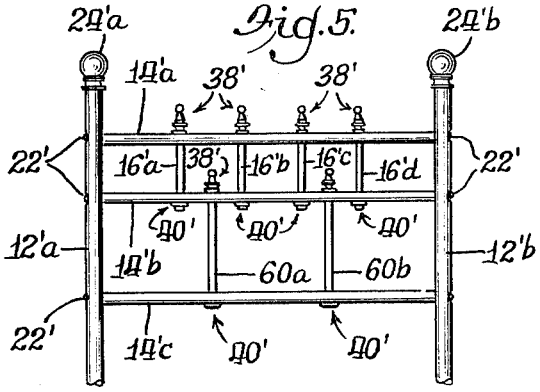
FIG. 5 is a fragmentary elevational view of an alternative bedstead design constructed in accordance with the present invention.

FIG. 5 illustrates an alternative frame assembly, preferably made of metallic tubing, in the form of a bedstead headboard employing elongate lateral standards 12'*a* and 12'*b* to and between which tubular cross rails 14'*a*, 14'*b* and 14'*c* are suitably secured so as to establish a headboard frame. In the embodiment of FIG. 5, a plurality of identical tubular spindles 16'*a–d* are connected to and between the upper pair of parallel cross rails 14'*a* and 14'b in transverse relation thereto through upper and lower connector means 38' and 40' in similar fashion to connection of the aforedescribed spindles 16a–d between the cross rails 14a, b in the embodiment of FIG. 1. Additionally, the embodiment of FIG. 5 has a pair of additional tubular spindles 60a and 60b secured to and between the cross rails 14'b and 14'c through similar upper and lower connecting means 38' and 40' in accordance with the present invention. It will be appreciated that other headboard or footboard designs could be readily prepared through interconnection of suitable standards, cross rails and spindles in accordance with the connecting means of the present invention.

While a preferred embodiment of the present invention has been illustrated and described, it will be understood to those skilled in the art that changes and modifications may be made therein without departing from the invention in its broader aspects.

Various features of the invention are defined in the following claims.

What is claimed is:

1. In a frame assembly for use in a bedstead or the like having a pair of lateral standards, and at least one pair of tubular cross rails disposed substantially transverse to said lateral standards and having opposite ends connected thereto, said cross rails having transverse openings fully therethrough so as to cooperate to define at least one pair of axially aligned openings; the improvement therewith comprising at least one spindle disposed between said cross rails and having tubular opposite ends proximate each opening of said at least one pair of axially aligned openings, and means connecting said opposite ends of said spindle to said cross rails, said connecting means including at least one connector member separate from said spindle and adapted to be inserted through one of said pair of axially aligned openings and axially into the corresponding proximate end of said spindle in close fitting relation therewith so as to maintain said corresponding end of said spindle in relatively fixed relation to the corresponding cross rail, said at least one connector member defining a stop surface cooperable with said corresponding end of said spindle for limiting insertion of said connector member and being adapted for snap-fit connection with said corresponding cross rail internally thereof so as to substantially prevent withdrawal of said connector member from said corresponding cross rail.

2. A frame assembly as defined in claim 1 including a pair of said connector members associated with each spindle, each of said connector members being adapted to be inserted within a separate one of said pair of axially aligned openings in said cross rails and into the corresponding proximate end of said spindle so as to maintain both ends of said spindle in fixed relation to said cross rails.

3. A frame assembly as defined in claim 1 wherein said cross rails define a plurality of said transverse openings therethrough so as to define a plurality of pairs of axially aligned openings, and including a plurality of spindles disposed between said cross rails so as to be axially aligned with corresponding pairs of said axially aligned openings in said cross rails, each of said spindles having opposite ends proximate said cross rails, and including substantially identical connector means operatively associated with each end of each of said spindles for connecting said spindle ends to said associated cross rails, said connecting means including at least one of said connector members adapted to be inserted through each of said axially aligned openings and into the corresponding proximate end of a spindle so as to maintain said spindles in relatively fixed relation to said cross rails, each of said connector means being adapted for said snap-fit connection with its associated cross rail internally thereof.

4. A frame assembly as defined in claim 3 wherein said spindles are connected to said cross rails in substantially identical fashion and are disposed in parallel spaced relationship coplanar with said cross rails.

5. A frame assembly as defined in claim 1 wherein said spindle is tubular, said connector member having a first body portion adapted to be received in sliding relation within said corresponding proximate end of said spindle and having an enlarged opposite end portion adapted for abutment with said associated cross rail exteriorly of said one of said pair of axially aligned openings through which said connector member is inserted.

6. A frame assembly as defined in claim 5 wherein said connector member has an annular retainer boss thereon adapted for snap-fit passage into said one of said axially aligned openings so as to be disposed internally of said tubular cross member and cooperate with said enlarged opposite end portion of said connector member to fixedly position said connector member within said corresponding cross rail.

7. A frame assembly as defined in claim 5 wherein said first body portion of said connector member has longitudinal ribs formed thereon to facilitate escape of air from said spindle during insertion of said first body portion into said spindle.

8. A frame assembly as defined in claim 2 wherein said spindle has its opposite ends inserted within said axially aligned openings from the ends thereof opposite said connector members.

9. A kit for making a frame assembly adapted for use in a bedstead or the like, said kit comprising a pair of elongate standards, at least one pair of tubular cross rails having opposite ends adapted for connection to said standards in substantially transverse relation thereto, said cross rails having transverse openings therethrough disposed so as to define axially aligned pairs of openings when said cross rails are connected to said elongate standards in substantial and transverse relation thereto, at least one spindle having opposite ends adapted to be disposed in proximate relation to said cross rails when connected to said standards with said spindle axially aligned with a pair of said axially aligned openings, and means for connecting said opposite ends of said spindle to said cross rails when said spindle is disposed with its opposite ends proximate said cross members in said axially aligned relation with said aligned openings, said connecting means including at least one connector member adapted to be inserted through one of said axially aligned openings and into a corresponding proximate end of a spindle, said connector member being adapted for snap-fit connection with the associated cross rail internally thereof so as to substantially prevent withdrawal of said connector member from said associated cross rail when assembled therein in connected relation with said spindle.

10. A kit as defined in claim 9 wherein said cross rails include a plurality of transverse openings therethrough adapted to define a plurality of pairs of axially aligned openings when said cross rails are connected transversely to said standards, and including a plurality of said spindles, and connecting means adapted for connecting the opposite ends of each of said spindles to said cross rails in axial alignment with a pair of said axially aligned openings, said connecting means being adapted for snap-fit connection with said cross rails so as to facilitate connection of said spindles to said cross rails without need for tools.

11. A frame assembly for use in a bedstead or the like, comprising a pair of lateral standards, at least one pair of cross rails connected adjacent their opposite ends to said lateral standards, said cross rails having transverse openings fully therethrough so as to define at least one pair of axially aligned openings, at least one spindle disposed between said cross rails and having opposite tubular ends proximate each of said at least one pair of axially aligned openings, and means connecting said opposite ends of said spindle to said cross rails, said connecting means including at least one connector member separate from said spindle and adapted to be inserted through one of said pair of axially aligned openings and into the corresponding tubular proximate end of said spindle in snug fitting relation therewith so as to maintain said corresponding tubular end of said spindle in relatively fixed relation to the corresponding cross rail, said at least one connector member defining a stop surface cooperable with said corresponding tubular end of said spindle for limiting insertion of said connector and being adapted for snap-fit connection with said corresponding cross rail internally thereof so as to substantially prevent withdrawal of said connector member from said corresponding cross rail.

12. A frame assembly as defined in claim 11 including a pair of said connector members associated with each spindle, each of said connector members being adapted to be inserted within one of said pair of axially aligned openings in said cross rails and into the corresponding proximate end of said spindle so as to maintain both ends of said spindle in fixed relation to said cross rails, each of said connector members having snap-fit connection to its corresponding cross rail.

* * * * *